United States Patent [19]

Downey et al.

[11] Patent Number: 4,544,494

[45] Date of Patent: Oct. 1, 1985

[54] HOMOGENEOUS LAUNDRY DETERGENT SLURRIES CONTAINING AMPHOTERIC SURFACE-ACTIVE AGENTS

[75] Inventors: Gale D. Downey, Pennington, N.J.; Charles E. Jones, Yardley, Pa.

[73] Assignee: FMC Corporation, Philadelphia, Pa.

[21] Appl. No.: 599,391

[22] Filed: Apr. 12, 1984

[51] Int. Cl.[4] ..... C11D 17/06

[52] U.S. Cl. ..... 252/135; 252/140; 252/160; 252/174.17; 252/528; 252/547; 252/DIG. 2; 252/DIG. 7; 252/DIG. 14; 252/DIG. 15

[58] Field of Search ..... 252/135, 140, 160, 174.17, 252/528, 547, 548, DIG. 14, DIG. 2, DIG. 15, DIG. 7

[56] References Cited

U.S. PATENT DOCUMENTS

| | | | |
|---|---|---|---|
| 2,929,788 | 3/1960 | Freese et al. | 252/137 |
| 3,075,922 | 1/1963 | Wixon | 252/135 |
| 3,093,591 | 6/1963 | Freese | 252/106 |
| 3,151,084 | 9/1964 | Schiltz et al. | 252/137 |
| 3,232,878 | 2/1966 | Jones et al. | 252/110 |
| 3,332,877 | 7/1967 | Reuland et al. | 252/152 |
| 3,351,557 | 11/1967 | Almstead et al. | 252/106 |
| 3,630,922 | 12/1971 | McClain et al. | 252/99 |
| 3,928,251 | 12/1975 | Bolich, Jr. et al. | 252/545 |
| 4,107,096 | 8/1978 | McEntire et al. | 252/546 |
| 4,268,406 | 5/1981 | O'Brien et al. | 252/105 |
| 4,316,812 | 2/1982 | Hancock et al. | 252/99 |
| 4,375,421 | 3/1983 | Rubin et al. | 252/174.19 |
| 4,414,128 | 11/1983 | Goffinet | 252/545 |

FOREIGN PATENT DOCUMENTS 2028365 3/1980 United Kingdom .

*Primary Examiner*—Paul Lieberman
*Assistant Examiner*—Hoa Van Le
*Attorney, Agent, or Firm*—Frank Ianno; Eugene G. Seems

[57] ABSTRACT

A stable, homogeneous, aqueous detergent slurry is described containing an amphoteric surface-active agent. The slurry contains about 14 weight percent to 30 weight percent of a sodium polyphosphate, about 1 weight percent to 5 weight percent of an alkali metal hydroxide or alkali metal salt, a soluble anionic surface-active agent, about 0.5 to 5 weight percent of an amphoteric surface-active agent which is selected from the group consisting of N-coco $\beta$-amino propionic acid; N-lauryl-, myristyl $\beta$-amino propionic acid; disodium N-tallow $\beta$-iminodipropionate; N-coco $\beta$-amino butyric acid; and coco betaine, wherein sodium polyphosphate is present as insoluble particles having an average diameter of about 1 to about 10 microns, and the total amount of surface-active agents are from 13 weight percent to 20 weight percent.

15 Claims, No Drawings

HOMOGENEOUS LAUNDRY DETERGENT SLURRIES CONTAINING AMPHOTERIC SURFACE-ACTIVE AGENTS

The present invention relates to built laundry detergent compositions, and specifically to such compositions which are stable, homogeneous slurries. In the detergent art, it is known that laundry formulations contain builders which enhance the cleaning ability of the formulation. The most popular of these builders, because of availability and cost, are sodium polyphosphates, of which sodium tripolyphosphate is the most commonly used.

The sodium polyphosphate builder, and particularly sodium tripolyphosphate, is known to function in laundry detergents in many ways to enhance the cleaning power of the detergents. For example, when dissolved in the aqueous medium in which clothes are being washed, it acts to sequester heavy metal ions thereby softening the water used for washing. The sodium tripolyphosphate functions cooperatively with the surfactants present in the detergent formulation to enhance the removal of oils and dirt particles from the garments being washed and helps to maintain these removed oils and particles in suspension as a fine emulsion or dispersed particles in the wash water. Thus, the sodium tripolyphosphate serves to increase the detergency function of the laundry formulation by maintaining the removed oils and particles dispersed in suspension so that they can be separated along with the wash water from the garments being cleaned.

The incorporation of sodium polyphosphates, such as sodium tripolyphosphate, in detergent compositions presents no problem when these compositions are in solid form. Almost any amount of sodium tripolyphosphate can be incorporated in solid detergent compositions, whether they be in form of the powders, granules or tablets, since the sodium tripolyphosphate can be made in bulk densities corresponding to the bulk density of the detergent composition. By this means, a homogeneous detergent composition is maintained regardless of the amount of sodium tripolyphosphate employed. Indeed, this is one of the reasons why such solid detergent compositions have been so popular and still comprise the bulk of the detergent formulations sold in the marketplace.

There is an increasing desire in the detergent industry to employ liquid detergent compositions instead of their solid counterparts because of the advantages the liquid compositions possess when compared with the solid formulations. The advantages of these liquid formulations include a positive means for mechanically dispensing measured doses in automatic washing machines compared with the solid compositions which give rise to blockages or residue in delivery tubes. The liquid formulations also eliminate dusting which often accompanies the measurement and dispensing of powdered laundry detergents. Caking of such powdered detergents is also encountered, which prevents proper dispensing. Another advantage is that the liquids are homogeneous and there is no problem with segregation of different ingredients that may have different sizes or specific gravities in the powdered laundry detergent. Still another advantage of the liquid detergent formulations is that they can be applied directly to soiled areas on the articles being cleaned to improve removal of localized, deeply embedded stains and dirt on any such garments.

One problem that has arisen in the use of these liquid detergent compositions is that popular builders such as the sodium polyphosphates, and in particular sodium tripolyphosphate, have a limited solubility in the aqueous composition on the order of about 14% by weight. This figure may be decreased substantially because of the addition of other ingredients to the composition, notably the presence of certain surface-active agents. This means that the amount of sodium tripolyphosphate desired to be added to the liquid detergent composition would exceed its solubility and would result in a composition which no longer is a purely liquid detergent composition. One way to overcome this problem is to use the potassium salt in place of the sodium salt of a polyphosphate, such as potassium tripolyphosphate, which is much more soluble than its sodium equivalent, and can be put in large amounts without exceeding its solubility limits. Another technique is to use sodium tripolyphosphate in combination with large amounts of soluble potassium salts, for example, potassium chloride, which also has the effect of solubilizing the sodium tripolyphosphate. Both of these techniques are undesired because of the high cost of either potassium tripolyphosphate or the potassium salts necessary to solubilize the sodium tripolyphosphate.

Another approach to this problem is to employ sodium tripolyphosphate in liquid detergents in excess of its solubility to form slurries, and to utilize such pourable slurries in the same way as a liquid detergent. This approach gives rise to two requirements. The first is that of keeping the undissolved sodium tripolyphosphate in a homogeneous suspension in the detergent slurry to insure uniform dispensing of the ingredients regardless of which portion (first or last) of the detergent slurry is dispensed. The second is to keep the detergent slurry stable so that separation of the aqueous phase from the surface-active agents does not occur. In general, substantial amounts of surface-active agents must be incorporated with the sodium tripolyphosphate in order to secure optimum cleaning with the slurry formulation and there is a tendency to obtain separation of these two liquid phases when the desired large amounts of surface-active agents, that is, about 13 weight percent to about weight percent of the formulation, is included in such detergent slurry composition.

It has now been found that a stable, homogeneous, aqueous detergent slurry can be formulated containing amphoteric surface-active agents comprising:

a. a sodium polyphosphate in amounts of from about 14 weight percent to about 30 weight percent, b. an alkali metal salt or hydroxide in amounts of from about 1 weight percent to about 5 weight percent, c. a soluble anionic surface-active agent selected from alkyl-, alkylaryl-, alkene-sulfate salts and alkyl-, alkylaryl-, alkene-sulfonate salts, d. a soluble anionic surface-active agent which is an alkali metal alcohol alkoxy sulfate in amounts of from about 0 to about 5 weight percent, e. sodium carboxymethylcellulose in amounts of from about 0.1 to about 1 weight percent, f. an amphoteric surface-active agent selected from the group consisting of N-coco $\beta$-amino propionic acid; N-lauryl-, myristyl $\beta$-amino propionic acid, disodium N-tallow $\beta$-iminodipropionate; N-coco $\beta$-amino butyric acid; and coco betaine in amounts of about 0.5 weight percent to about 5 weight percent, g. said sodium polyphosphate being present in part as insoluble particles having an average diameter of about 1 to about 10 microns, and h. the total amount of surface-active agents in said detergent slurry being from about 13 weight percent to about 20 weight percent.

In the formulation of the present slurry, it is desired to have the undissolved sodium polyphosphate present in the form of insoluble particles having an average diameter of about 1 to about 10 microns. This size is desired to assure that any undissolved sodium polyphosphate will remain in the formulation as a homogeneous slurry that remains pourable. If the undissolved particles of sodium polyphosphate are too large, they will settle from the remainder of the formulation. If the particles are too small, they will form a gel-like mass that will not have the desired flow characteristics of a pourable liquid.

One method for producing the present slurry formulation is to first dissolve an alkali metal salt or alkali metal hydroxide, in amounts of from 1 weight percent to about 5 weight percent, in the requisite amount of water to form a solution containing an alkali metal ion, preferably sodium or potassium ion. To this solution is added 0.1 to about 1 weight percent of sodium carboxymethylcellulose (CMC) with stirring until dissolved. The addition of the CMC should precede addition of any insolubles to the formulation. However, the CMC can be added either prior to or after the addition of the alkali metal salt or hydroxide.

The desired sodium polyphosphate, and preferably sodium tripolyphosphate, is then added in amounts of about 14 weight percent to about 30 weight percent. The added sodium polyphosphate dissolves up to the limit of its solubility and the remainder, which cannot stay dissolved, recrystallizes from the aqueous solution to form insoluble particles having an average diameter of about 1 to about 10 microns.

The alkali metal salt or alkali metal hydroxide, which is used in amounts of from about 1 weight percent to about 5 weight percent, is preferably sodium carbonate, sodium hydroxide or sodium bicarbonate, although other alkali metal salts or hydroxides may also be used. These include potassium hydroxide, potassium carbonate, potassium bicarbonate, sodium sesquicarbonate, potassium sesquicarbonate, sodium borate, potassium borate, potassium sulfate, sodium sulfate, sodium chloride, potassium chloride, sodium orthophosphate, tetrasodium pyrophosphate or tetrapotassium pyrophosphate.

The sodium polyphosphate employed is preferably sodium tripolyphosphate but other polyphosphate mixtures can be employed such as tetrasodium pyrophosphate, and mixtures of sodium tripolyphosphate and tetrasodium pyrophosphate. When sodium tripolyphosphate is employed, the form known as Form I, that is containing at least 10% to 40% of Form I, is preferred for this purpose. If it is desired to use sodium tripolyphosphate which is essentially Form II sodium tripolyphosphate (that is containing less than 6% of Form I), it is more desirable if it is moisturized so that it contains at least about ½% by weight of water or above. For ease of dissolving, powdered sodium tripolyphosphate (typically 95 weight percent minimum −100 mesh) is preferred.

The mixing of sodium polyphosphate and the remaining ingredients of the slurry into the aqueous solution should be done with a high speed, high shear stirrer. Rapid agitation with high shear is desired during mixing of the sodium polyphosphate in the initial step and in the subsequent steps of adding the remainder of the ingredients to the slurry composition. The high shear action of the mixing stirrer is especially necessary to intimately mix the subsequently added surface-active agents with the aqueous portion of the slurry in order to obtain a slurry composition that is stable, so that separation of an aqueous phase from the surface-active agents does not occur.

After mixing of the alkali metal salt or alkali metal hydroxide, CMC and sodium polyphosphate, the next ingredient that is added, with high shear stirring, is one of the soluble anionic surface-active agents described herein. The preferred anionic surface-active agent employed is sodium dodecylbenzene sulfonate (Sulframin 85), generally in the form of a premixed and heated (60° C.) aqueous solution of sodium dodecylbenzene sulfonate, although the sodium salt can be added neat.

Other such water-soluble anionic sulfonate or sulfate surface-active agents useful in the present composition include alkali metal salts of: alkyl sulfonates, such as $C_{10}$–$C_{20}$ alkyl sodium sulfonate; alkylaryl sulfonates, such as $C_{10}$–$C_{16}$ alkyl benzene sodium sulfonate; alkene sulfonates, such as the $C_{10}$–$C_{20}$ alkene sodium sulfonate; alkyl sulfates, such as $C_8$–$C_{20}$ alkyl sodium sulfates, preferably sodium lauryl sulfate; alkylaryl sulfates, such as $C_{10}$–$C_{16}$ alkyl benzene sodium sulfate; alkene sulfates, such as $C_{10}$–$C_{20}$ alkene sodium sulfate. The $C_{10}$–$C_{14}$ alkyl benzene sodium sulfonates are the preferred class of anionic surface-active agents useful in this invention.

The second water-soluble anionic surface-active agent which is desirable in the preferred embodiment of the invention is an alkali metal alcohol alkoxy sulfate which is added with high shear stirring. When employed, it is used in amounts of about 1 to 5 weight percent. The preferred embodiment is a sodium ethoxylated alcohol sulfate, sold as Neodol 25-3S, which is the reaction product of 1 mole of a $C_{12}$–$C_{15}$ alcohol with 3 moles of ethoxylate, and which is sulfated and recovered as its sodium salt.

Thereafter, the amphoteric surface-active agent is added, with rapid agitation by means of a high speed, high shear stirrer in amounts of about 0.5 weight percent to about 5 weight percent. The amphoteric surface-active agents useful in the present formulations are N-coco β-amino propionic acid, N-lauryl- and myristyl β-aminopropionic acid, disodium N-tallow β-iminodipropionate, N-coco β-amino butyric acid, coco betaine, or mixtures thereof.

Typical trade names under which these amphoteric surface-active agents are supplied are set forth below:

| Surface-Active Agent | Structure |
|---|---|
| Deriphat 151C ® | N—coco β-amino propionic acid (42% active ingredients) |
| Deriphat 170C ® | N—lauryl-, myristyl β-amino propionic acid (50% active ingredients) |
| Deriphat 154 ® | Disodium N—tallow β-imino dipropionate (97%) |
| Armeen Z ® | N—coco β-amino butyric acid (55%) |
| Velvetex AB-45 ® | coco betaine (45%) |

If desired, additional surface-active agents may also be employed. However, the total amount of surface-active agents in the slurry can range from about 13 weight percent to about 20 weight percent and these amounts include not only the surface-active agents referred to above but also any additional surface-active agents which may be desired to be added to the formulation.

In addition to the above ingredients, the slurry may also contain other well-known ingredients normally used in laundry detergents such as an anti-redeposition agents, optical brighteners, alkali silicates for corrosion control and enhanced cleaning, coloring agents, perfumes, foam depressants, enzymes and the like.

A typical formulation of the present invention is set forth below:

FORMULATION I

| Ingredient | Weight Percent (100% Active Compounds) |
|---|---|
| Sodium Carbonate | 3% |
| Sodium Carboxymethylcellulose | 0.5% |
| Sodium Tripolyphosphate | 15.2% |
| Sodium Dodecylbenzene Sulfonate (Sulframin 85) ® | 10.4% |
| $C_{12}$-$C_{15}$ alcohol sodium ethoxysulfate (Neodol 25-3S) ® | 3% |
| N—coco β-amino propionic acid (Deriphat 151C) ® | 0.63% |
| Optical brightener (Tinopal RBS-200) ® | 0.5% |
| Water | q.s. |

The liquid detergent formulation set forth in Formulation I was prepared in the following manner: a 1.5 kilograms batch of the detergent slurry was prepared by charging 663.0 grams of deionized water into a clean 2-liter polyethylene vessel containing four baffles to enhance good mixing. The polyethylene vessel was provided with a variable speed mixer and a 3-blade high shear impeller. First 7.5 grams of sodium carboxymethylcellulose was dissolved in the water, with a minimum amount of agitation. With the mixer set at medium speed, 45.0 grams of sodium carbonate was added and mixed for 5 minutes. After the sodium carbonate was completely dissolved, 228.0 grams of Form I sodium tripolyphosphate powder (over 95 weight percent −100 mesh) was gradually added to the mixture and further mixed for 10 minutes while the stirrer was set at a maximum speed setting. Thereafter, all other additions that followed were also performed with the stirrer at a maximum speed setting. After completion of 20 minutes of sodium tripolyphosphate addition and mixing, a premixed and heated (60° C.) solution of 183.0 grams of 85% active sodium dodecylbenzene sulfonate (Sulframin 85) and 303.0 grams of water were added and mixed for an additional 10 minutes. Thereafter, 75.0 grams of 60% active $C_{12}$–$C_{15}$ alcohol ethoxysulfate, sodium salt (Neodol 25–3S) was added and mixed for 10 minutes. Subsequently, 22.5 grams of (42% active) N-coco β-amino propionic acid (Deriphat 151C) was added and mixed for an additional 10 minutes. Finally, 7.5 grams of the optical brightener (Tinopal RBS-200) were dispersed in 15.0 grams of deionized water and the mixture added to the slurry with an additional 5 minutes of mixing. The resulting laundry detergent slurry was a stable, cream colored, opaque, homogeneous and pourable liquid. Upon extended storage for several months, the slurry remained homogeneous and pourable, and was stable without breaking up into distinct liquid layers of water and surface-active agents.

One of the advantages of the present slurries compared to the purely liquid laundry detergent formulations is the increased stability against hydrolysis which is imparted to the sodium tripolyphosphate. In general, sodium tripolyphosphate when dissolved in liquid detergent formulations will gradually hydrolyze to sodium orthophosphate over a period of time. This means that the formulations' shelf-life is limited since the formulation must be used prior to the hydrolysis of the sodium tripolyphosphate ingredient to obtain the benefit of the builder effect that sodium tripolyphosphate imparts to the formulation. In the instant slurry formulation, the major proportion of sodium tripolyphosphate is present as an insoluble in the slurry. In this insoluble state, the sodium tripolyphosphate does not appreciably hydrolyze to sodium orthophosphate. The only portion of the sodium tripolyphosphate that is subject to some hydrolysis is the minor portion of sodium tripolyphosphate that remains dissolved in the slurry formulation. As a result, the present slurry formulation has a much greater shelf-life, from the point of view of stability of the sodium tripolyphosphate, than does the purely liquid detergent formulations. To this extent, the present slurry formulations exhibit the same desired hydrolytic stability of sodium tripolyphosphate as do dry formulations.

The following examples are given to illustrate the present invention and are not deemed limiting thereof. The formulations were prepared using essentially the same procedure as described above for preparing Formulation I. The stability tests for these formulations included one month of ambient shelf storage, followed by five freeze-thaw cycles, a high temperature storage and finally several months of ambient shelf storage.

Pursuant to the requirements of the patent statutes, the principle of this invention has been explained and exemplified in a manner so that it can be readily practiced by those skilled in the art, such exemplification including what is considered to represent the best embodiment of the invention. However, it should be clearly understood that, within the scope of the appended claims, the invention may be practiced by those skilled in the art, and having the benefit of this disclosure, otherwise than specifically described and exemplified herein.

TABLE I

| | Weight Percent of Ingredients of Amphoteric Detergent Slurries | | | | | | | | |
|---|---|---|---|---|---|---|---|---|---|
| Sample | Water[1] | CMC[2] | $Na_2CO_3$[3] or other | STPP[4] | LAS[5] or other/$H_2O$ | Deriphat 151C or other Amphoteric | Neodol[7] 25-3S | Tinopal[8] RBS-200/$H_2O$ | Stability |
| 1 | 43.0 | 0.5 | 3.0 | 15 | 12/20 | 2.0 | 3.0 | 0.5/1.0 | Pourable, homogeneous and stable |
| 2 | 41.0 | 0.5 | 3.0 | 15 | 12/20 | 2.0 | 5.0 | 0.5/1.0 | Pourable, homogeneous and stable |
| 3 | 43.0 | 0.5 | 3.0 | 15 | 12/20 | Deriphat 170C 2.0 | 3.0 | 0.5/1.0 | Pourable, homogeneous and stable |

TABLE I-continued

| Sample | Water[1] | CMC[2] | $Na_2CO_3$[3] or other | STPP[4] | LAS[5] or other/$H_2O$ | Deriphat 151C or other Amphoteric | Neodol[7] 25-3S | Tinopal[8] RBS-200/$H_2O$ | Stability |
|---|---|---|---|---|---|---|---|---|---|
| | | | Weight Percent of Ingredients of Amphoteric Detergent Slurries | | | | | | |
| 4 | 41.0 | 0.5 | 3.0 | 15 | 12/20 | Deriphat 170C 2.0 | 5.0 | 0.5/1.0 | Pourable, homogeneous and stable |
| 5 | 43.0 | 0.5 | 3.0 | 15 | 12/20 | Deriphat 154 2.0 | 3.0 | 0.5/1.0 | Pourable, homogeneous and stable |
| 6 | 42.0 | 0.5 | 3.0 | 15 | 12/20 | Armeen Z 2.0 | 3.0 | 0.5/1.0 | Pourable, homogeneous and stable |
| 7 | 42.0 | 0.5 | 3.0 | 15 | 12/20 | Velvetex AB-45 2.0 | 3.0 | 0.5/1.0 | Pourable, homogeneous and stable |

[1]Weight percent of starting water in mixer
[2]Sodium carboxymethylcellulose; added prior to $Na_2CO_3$ or other alkali metal salts
[3]$Na_2CO_3$ - sodium carbonate
[4]STPP - sodium tripolyphosphate, powdered (95%-100 mesh)
[5]Linear alkylaryl sulfonate - Sulframin 85 (sodium dodecylbenzene sulfonate) 85% active ingredients, mixed with listed weight percent of water
[6]Deriphat 151C - amphoteric surface-active agent, 42% active ingredient
[7]Neodol 25-3S - anionic surface-active agent, 60% active ingredient
[8]Tinopal RBS-200 - optical brightener, mixed with listed weight percent of water

What is claimed is:

1. A stable, homogeneous, aqueous detergent slurry consisting essentially of:

a. a sodium polyphosphate in amounts of from about 14 weight percent to about 30 weight percent, b. an alkali metal hydroxide or alkali metal salt selected from the group consisting of sodium carbonate, sodium hydroxide, sodium bicarbonate, potassium hydroxide, potassium carbonate, potassium bicarbonate, sodium sesquicarbonate, potassium sesquicarbonate, sodium borate, potassium borate, potassium sulfate, sodium sulfate, sodium chloride, potassium chloride, sodium orthophosphate, tetrasodium pyrophosphate and tetrapotassium pyrophosphate in amounts of from about 1 weight percent to about 5 weight percent, c. a soluble, anionic surface-active agent selected from the group consisting of alkyl-, alkylaryl-, alkene-sulfate salts and alkyl-, alkylaryl-, and alkene-sulfonate salts, d. a soluble, anionic surface-active agent which is an alkali metal alcohol alkoxylate sulfate in amounts of about 0 to about 5 weight percent, e. sodium carboxymethylcellulose in amounts of from about 0.1 to about 1 weight percent, f. an amphoteric surface-active agent selected from the group consisting of N-coco $\beta$-amino propionic acid; N-lauryl-, myristyl $\beta$-amino propionic acid; disodium N-tallow $\beta$-iminodipropionate; N-coco $\beta$-amino butyric acid; and coco betaine in amounts of about 0.5 to about 5 weight percent, g. said sodium polyphosphate being present in part as insoluble particles having an average diameter of about 1 to 10 microns, and h. the total amount of the above surface-active agents in said detergent slurry being from about 13 weight percent to about 20 weight percent.

2. The detergent slurry of claim 1 wherein the sodium polyphosphate is sodium tripolyphosphate.

3. The detergent slurry of claim 1 wherein said alkali metal salt and alkali metal hydroxide are selected from the group consisting of sodium carbonate, sodium hydroxide and sodium bicarbonate.

4. The detergent slurry of claim 1 wherein said alkali metal salt is sodium carbonate.

5. The detergent slurry of claim 1 wherein said soluble, anionic surface-active agent is sodium dodecylbenzene sulfonate.

6. The process of claim 1 wherein the soluble, anionic surface-active agent is sodium lauryl sulfate.

7. The detergent slurry of claim 1 wherein the amphoteric surface-active agent is N-coco $\beta$-amino propionic acid.

8. The detergent slurry of claim 1 wherein the amphoteric surface-active agent is N-lauryl-, myristyl $\beta$-amino propionic acid.

9. The detergent slurry of claim 1 wherein the amphoteric surface-active agent is disodium N-tallow $\beta$-iminodipropionate.

10. The detergent slurry of claim 1 wherein the amphoteric surface-active agent is N-coco $\beta$-amino butyric acid.

11. The detergent slurry of claim 1 wherein the amphoteric surface-active agent is coco betaine.

12. The detergent slurry of claim 1 wherein the soluble, anionic surface-active agent is a $C_{10}$–$C_{20}$ alkyl sodium sulfonate.

13. The detergent slurry of claim 1 wherein the soluble, anionic surface-active agent is a $C_{10}$–$C_{16}$ alkyl benzene sodium sulfonate.

14. The detergent slurry of claim 1 wherein the soluble, anionic surface-active agent is a $C_{10}$–$C_{20}$ alkene sodium sulfonate.

15. The detergent slurry of claim 1 wherein the soluble, anionic surface-active agent is a $C_8$–$C_{20}$ alkyl sodium sulfate.

* * * * *